US007021487B2

(12) United States Patent
Kikkawa et al.

(10) Patent No.: US 7,021,487 B2
(45) Date of Patent: Apr. 4, 2006

(54) PROCESSING METHOD FOR HIGH PRESSURE GAS CONTAINER AND HALOGEN CONTAINING GAS FILLED IN SAID CONTAINER

(75) Inventors: Akio Kikkawa, Shimonoseki (JP); Shigeo Kanayama, Shimonoseki (JP); Isao Harada, Shimonoseki (JP)

(73) Assignee: Mitsui Chemicals, Inc., Tokyo (JP)

( * ) Notice: Subject to any disclaimer, the term of this patent is extended or adjusted under 35 U.S.C. 154(b) by 268 days.

(21) Appl. No.: 10/633,552

(22) Filed: Aug. 5, 2003

(65) Prior Publication Data

US 2004/0026417 A1 Feb. 12, 2004

(30) Foreign Application Priority Data

Aug. 5, 2002 (JP) ..... 2002-226955
Feb. 19, 2003 (JP) ..... 2003-040562
Feb. 19, 2003 (JP) ..... 2003-040563

(51) Int. Cl.
*B44C 1/22* (2006.01)
*F17C 1/00* (2006.01)

(52) U.S. Cl. ..... 220/581; 216/52; 216/53; 216/99; 216/100; 423/406; 423/415.1; 423/439; 423/481; 423/483; 423/491; 423/492; 423/494; 423/500

(58) Field of Classification Search ..... 216/52, 216/53, 99, 100; 220/581; 423/439, 500, 423/406, 481, 483, 491, 492, 494, 415.1
See application file for complete search history.

(56) References Cited

U.S. PATENT DOCUMENTS

| | | | | |
|---|---|---|---|---|
| 2,419,915 | A * | 4/1947 | Priest et al. | 220/62.17 |
| 4,284,617 | A * | 8/1981 | Bowen et al. | 423/504 |
| 4,494,666 | A * | 1/1985 | Cooper et al. | 220/582 |
| 4,948,571 | A * | 8/1990 | Harada et al. | 423/240 S |
| 5,928,743 | A * | 7/1999 | Bealky et al. | 428/35.8 |
| 6,290,088 | B1 * | 9/2001 | Zdunek et al. | 220/586 |
| 6,507,020 | B1 * | 1/2003 | Shiokawa et al. | 250/288 |
| 2003/0038110 | A1 * | 2/2003 | Bachrach et al. | 216/52 |
| 2004/0037768 | A1 * | 2/2004 | Jackson | 423/500 |

* cited by examiner

*Primary Examiner*—Wayne A. Langel
(74) *Attorney, Agent, or Firm*—Buchanan Ingersoll, PC

(57) ABSTRACT

A metal container to be filled with a halogen containing gas, with the inner surface processed with a polishing agent. The gas has a reduced purity decline by the increase of the water content or impurities from the inner surface of the container which is absorbed by the gas over the passage of time. The inner surface processing method is improved such that the value of dividing the area of the Si2s peak by the area of the $Fe2p_{3/2}$ peak in the X-ray photoelectron spectrum of the gas container inner surface with the inner surface process with a polishing agent applied is 0.3 or less.

5 Claims, 2 Drawing Sheets

PROCESSING METHOD FOR HIGH PRESSURE GAS CONTAINER AND HALOGEN CONTAINING GAS FILLED IN SAID CONTAINER

BACKGROUND OF THE INVENTION

1. Field of the Invention

The present invention relates to a processing method for a high pressure gas container. More specifically, it relates to a processing method for a high pressure gas container with a certain amount or less of the Si amount in the inner surface uppermost layer part, and a halogen containing gas filled in the high pressure gas container. Further specifically, it relates to a processing method for a high pressure gas container of applying a pressure test by hydraulic pressure, and polishing the inner surface thereof to a certain depth, and a halogen containing gas filled in the high pressure gas container.

2. Description of the Related Art

The halogen containing gases are used as a doping agent for the semiconductors, a dry etching agent, or a cleaning gas for a CVD device, and high pureness is required for the halogen containing gases used for these applications. To a filling container for these highly pure gases, the inner surface polishing process is applied frequently for preventing adsorption of water or impurity gases to its inner surface and keeping the high pureness of the filled gas. However, among the halogen containing gases filled in the container with the inner surface polishing process applied, there are sometimes those having the impurity concentration raised according to passage of time. One of the impurities is water, and the other one is a halogen containing unknown impurity.

As a result of our research for the cause of the increase of the water content in the gas according to the passage of the time, it was learned that the trouble of the water content increase by the time passage can easily be generated in the case the container after having the pressure test by the hydraulic pressure is used. As a result of the further detailed analysis, it was revealed that a water content, which cannot be removed by the drying process, remains in the container after the pressure test by hydraulic pressure, and the water content is introduced gradually into the gas filled in the container so as to increase the water content in the target gas according to time passage. Although there is a method of vacuuming the inside while heating the container, or the like, the water content cannot be removed completely, and an effective means of removing water has been desired.

Moreover, as a result of our research of the cause of the increase of the halogen containing unknown impurity by the time passage, it was learned that generation of the phenomenon is concentrated in the container after applying the internal surface polishing. There are various methods for the internal polishing, and a method of using a polishing agent is often adopted for its inexpensiveness and easiness. After executing the internal surface process using the polishing agent, in general, it is washed with water and/or a solvent, dried, and has a valve mounted so as to be used as a gas container. According to the halogen containing gas filled in the container with the internal surface treatment with the polishing agent, a problem is involved in that the purity is lowered by the increase of the unknown halogen containing impurity according to the passage of time after filling.

SUMMARY OF THE INVENTION

Accordingly, an object of the present invention is to provide a processing method for a high pressure gas container without the risk of generating the purity decline of a halogen containing gas, and furthermore, to provide a processing method for a high pressure gas container without the risk of generating the purity decline by the residual water content and to provide a high purity halogen containing gas filled in the container.

As a result of an investigation by the present inventors on a method for preventing the gas purity decline by introduction of the water content after filling the container, it was found out that the increase amount by the passage of time of the water content after filling the gas can be reduced by polishing the internal surface of the container by specific thickness after executing the pressure test by the hydraulic pressure so as to achieve the present invention. Furthermore, as a result of the elaborate discussion on the cause of the purity decline of the halogen containing gases filled in a gas container with the internal polishing process applied with a polishing agent, and the method for preventing the same, it was found out that the impurity causing the purity decline is a silicon halide that produced by the reaction of the residual Si content on the container inner surface with the filled gas, and the production of the silicon halide can be restrained by reducing the Si residual amount in the container inner surface top layer part quantitatively determined by X ray photoelectron spectroscopy to a certain level or less so that the purity decline of the halogen containing gas can be prevented extremely efficiently and economically so as to achieve the present invention.

That is, a first aspect of the present invention is a processing method for a high pressure gas container comprising the step of polishing the inner surface of a high pressure gas container mainly made of iron, which has had a pressure test by hydraulic pressure, by 5 to 100 μm thickness on average such that the value of dividing the area of the Si2s peak by the area of the $Fe2p_{3/2}$ peak in the X-ray photoelectron spectrum of the inner surface is 0.3 or less.

It is further preferable that the value of dividing the area of the Si2s peak by the area of the $Fe2p_{3/2}$ peak is 0.1 or less.

A second aspect is the method according to the first aspect, wherein at least the final polishing is conducted with a polishing agent having a Si content of 10 wt % or less.

It is preferable that the Si content is 1 wt % or less with respect to the polishing agent total weight, and furthermore, 100 wt ppm or less.

A third aspect is a halogen containing gas filled in a high pressure gas container processed by polishing the inner surface of a high pressure gas container mainly made of iron, which has had a pressure test by hydraulic pressure, by 5 to 100 μm thickness on average such that the value of dividing the area of the Si2s peak by the area of the $Fe2p_{3/2}$ peak in the X-ray photoelectron spectrum is 0.3 or less.

A fourth aspect is the halogen containing gas filled in a high pressure gas container according to the third aspect, wherein the silicon halide content is 0.3 ppm or less.

A fifth aspect is a method for processing the inner surface of a fluorine containing gas container mainly made of iron, which has had a pressure test by hydraulic pressure, comprising the step of executing at least the final polishing with a polishing agent having a Si content of 10 wt % or less.

A high pressure gas container processed by the processing method according to the present invention can be used preferably for a halogen containing gas, and it is suitable for a compound comprising at least one element selected from the group consisting of an F, a Cl, a Br and an I, which is a compressed gas or a liquefied gas in an ordinary temperature. As the examples thereof, $NF_3$, $ClF_3$, $CF_4$, $C_2F_6$, $C_3F_8$, $C_4F_6$, $SF_6$, $GeF_4$, $WF_6$, $F_2$, $COF_2$, $Cl_2$, HF, HCl, HBr, HI, or the like can be exemplified, and in particular, it is used most preferably for a halogen containing gas as $NF_3$, $ClF_3$, $CF_4$, $C_2F_6$, $C_3$, $F_8$, $C_4F_6$, $SF_6$, $GeF_4$, $WF_6F_2$, and $COF_2$.

The halogen containing gas is used often for the application as a doping agent for a semiconductor, a dry etching agent, and a cleaning gas for a CVD device, and high pureness is required thereto.

As the high pressure gas container mainly made of iron of the present invention, a container made of an iron-manganese steel, an iron-chromium-manganese steel, a stainless steel, a nickel steel, or an aluminum alloy steel can be exemplified. As the high pressure gas container, in general, one with the surface polished is used for preventing pollution by particles or an absorbed gas. In general, the internal surface coarseness (smoothness) is represented by the numerical value of the height difference between the concave portion and the convex portion by the micron order with S added. In general, one polished to 3S to 1S or less is used.

Moreover, the pressure test by hydraulic pressure in the present invention is conducted by filling water in the subject high pressure gas container, and applying a predetermined test pressure.

In the pressure test, in general, 25 MPa hydraulic pressure is applied on the container, and at the time, minute cracks are generated in the inner surface layer of the container. In the present invention, the "minute crack" means a crack with a depth in a range of 1 μm to 30 μm. The number, the length and the depth of the minute crack generated here differ depending on the material and the container processing method. In the case of an ordinary gas container made of an iron-manganese steel, the length of the minute crack is about 100 μm to 1 cm, the total length per one square centimeter is about 50 cm to 100 cm, and the depth is about 3 to 30 μm. According to the pressure test by hydraulic pressure, water permeates into the minute cracks so that it cannot be completely removed by an ordinary drying method, for example, by heating the container at 110 to 250° C. while applying vacuum in a range of 0.01 to 10 mmHg. The water content remaining in the container without being removed is gradually introduced into the gas after filling the target high purity gas so as to cause the water content increase by the passage of time in the high purity gas.

In order to reduce the water content residual amount in the inner surface of the container after applying the pressure test by hydraulic pressure for preventing the purity decline of the filled gas, it is preferable to remove the minute cracks by polishing the inner surface of the container. The polishing amount at the time is preferably 5 to 100 μm based on the average thickness, and it is further preferably 10 to 20 μm. In the case the polishing amount is less than 5 μm, the minute cracks may remain without being eliminated by a considerable amount. In contrast, in the case the polishing amount is more than 100 μm, although there is no major problem in terms of the container performance, such an excessive polishing process is wasteful in terms of the polishing agent consumption amount, and the time and labor needed for the process, and thus it is not preferable. Polishing by an extremely large amount of more than 1,000 μm may deteriorate the pressure resistance performance of the container, and thus it should be avoided.

According to the present invention, although sufficient effect can be provided by maintaining the above-mentioned polishing thickness, since the optimum polishing thickness differs slightly depending on the container material, optimum administration can be enabled by polishing with the amount of the remaining minute cracks in the container inner surface after polishing as the reference. It is preferable to execute the polishing process so as to have a 30 cm or less total length per one square centimeter of the minute cracks of 1 μm to 30 μm depth existing in the inner surface of the container, further preferably a 10 cm or less total length of the minute cracks of 1 μm to 30 μm depth.

There are various methods for the polishing process, and a processing method using a polishing agent by a wet method or a dry method is used frequently owing to its convenience and inexpensiveness of the process. According to the wet type polish, a barrel polish method of placing a polishing agent and water or a chemical in a container, putting on an airtight plug so as not to spill the contents, and providing the planetary motion rotation with the container turned sideways for polishing, is used commonly.

As the polishing agent used for the above-mentioned inner surface process, a diamond, a zirconia, an alumina, a silica, a silicon nitride, a silicon carbonate, a composite oxide of an alumina-silica, or the like can be exemplified. Among these examples, an alumina-silica composite oxide based polishing agent is used commonly and widely. In the case the polishing process of the container inner surface is conducted using a polishing agent containing an Si content, the Si component in the polishing agent tends to remain in the container inner surface top layer part after finishing the polish so that a silicon halide as an undesirable impurity in the use for the semiconductor application is produced by the reaction of the Si component with the halogen containing gas after filling a halogen containing gas. Therefore, according to the present invention, it is preferable to use a polishing agent having an Si content in the polishing agent solid component of 10 wt % or less based on the Si atoms, preferably 1 wt % or less, and further preferably 100 wt ppm or less. Specifically, a diamond, a zirconia, an alumina, or the like can be exemplified. In the case the container inner surface is polished to a 3S to 1S grade by applying the inner surface process using a polishing agent by two or more times, it is preferable to use the above-mentioned polishing agent in the final process. As long as the conditions are satisfied, the polishing agent may be a mixture and/or a composite substance, and two or more kinds of the polishing agents may be used in a combination. The Si content here means the ratio of the weight of the total Si atoms in the polishing agent with respect to the total weight (solid component) of the polishing agent in a dry state.

In the case the inner surface process is conducted using a polishing agent having more than 10 wt % Si content, the Si component tends to remain on the container inner surface after washing with water and/or a solvent and drying after the inner surface process. In particular, in the case a polishing agent having more than 10 wt % Si content is used at the time of the final inner surface process, the Si residual amount on the container inner surface is further increased.

In the case a halogen containing gas is filled in the container, the gas after filling reacts with the residual Si component of the polishing agent as the time passes so that a silicon halide is produced in the container inside so as to lower the pureness of the gas. The silicon halide is a substance represented by an SiFx, an SiClx, an SiBrx, an SiIx (wherein x represents a number more than 0 and 4 or less, which is not always an integer) and a gaseous substance or a liquid having a vapor pressure, or a sublimating solid. The silicon halide accordingly produced passes through a fine filter together with the halogen containing gas at the time of using the halogen containing gas for the semiconductor application so as to be introduced into the chamber for the semiconductor production and provides an adverse effect to the semiconductor performance.

Although the particle size of the polishing agent used in the present invention is not particularly limited, it is preferable to use several kinds of polishing agents having different particle sizes in combination for efficiently executing the inner surface process. More preferably, since the inner surface process can be conducted further effectively by using spherical large particles having a 1 to 20 mm average particle size and fine particles having a 1 to 100 μm average particle size as the polishing agent. The combination ratio of the polishing agents is not particularly limited, and the weight ratio of the fine particles with respect to the large particles is preferably 10 wt % or less.

Next, the method of the inner surface process of the container will be described in detail.

The inner surface process is conducted by a method for applying the rotation and revolution motion to the container itself by the so-called barrel polish method of placing a polishing agent in a container, putting on an airtight plug so as not to spill the contents, and providing the planetary motion rotation with the container turned sideways so as to process the inner surface according to the flow of the polishing agent inside the container while applying gravity. According to the inner surface process, in general, a liquid such as pure water, an oxidizing solvent, an alkaline solvent, or water with a surfactant added, or the like is added together with the polishing agent, and as needed, a corrosion preventing agent such as a nitrite can further be added.

After executing the inner surface process using the polishing agent, in general, it is washed with water and/or a solvent and dried, and used as a gas container with a valve mounted. Particularly in the case of using a polishing agent containing an Si component at the time of polishing, it is preferable to execute the washing process thoroughly by jet spraying water, or the like.

According to the present invention, by determining the Si residual amount in the container inner surface top layer part quantitatively by the analysis by X-ray photoelectron spectroscopy (XPS), and providing the above-mentioned schemes in the above-mentioned inner surface processing step and/or subsequent washing step, the peak area ratio of the Fe and the Si in the X-ray photoelectron spectrum of the container inner surface can be provided at a specific ratio or less. Thereby, a halogen containing gas filled in the container with the inner surface process by the polishing agent applied without substantial introduction of the silicon halide of 0.3 ppm or less can be provided.

According to the measurement of the X-ray photoelectron spectrum in the present invention, first, a test piece is prepared by first cutting the container in a columnar shape, and then cutting to about a 2 cm square size. In the specimen production, the greatest care should be given so as not to pollute the inner side of the container. With the specimen produced as mentioned above placed in a commercially available XPS measurement device, a monotone AlKα line (1486.6 eV) is irradiated to a 0.3 to 0.7 $mm^2$ area on the specimen and the photoelectrons were taken at a take-off angle of 45° to conduct spectroscopic analysis. The pass energy of the analyzer is set such that the half band width of the $Ag3d_{5/2}$ peak of the spectrum of a pure silver standard specimen becomes 0.8 eV or less.

The narrow scanning measurements of the Si2s area and the Fe2p area are determined with these conditions, and the value obtained by dividing the area of the Si2s peak by the $Fe2p_{3/2}$ peak is calculated. The value is preferably 0.3 or less, and it is more preferably 0.1 or less. In the case the above-mentioned value is more than 0.3, the silicon halide may increase by the passage of time after filling a halogen containing gas in the container so as to lower the gas purity, and thus it may not be preferable.

EXAMPLES

Hereinafter, the present invention will be explained further specifically with reference to the examples.

Example 1

Figure 1:
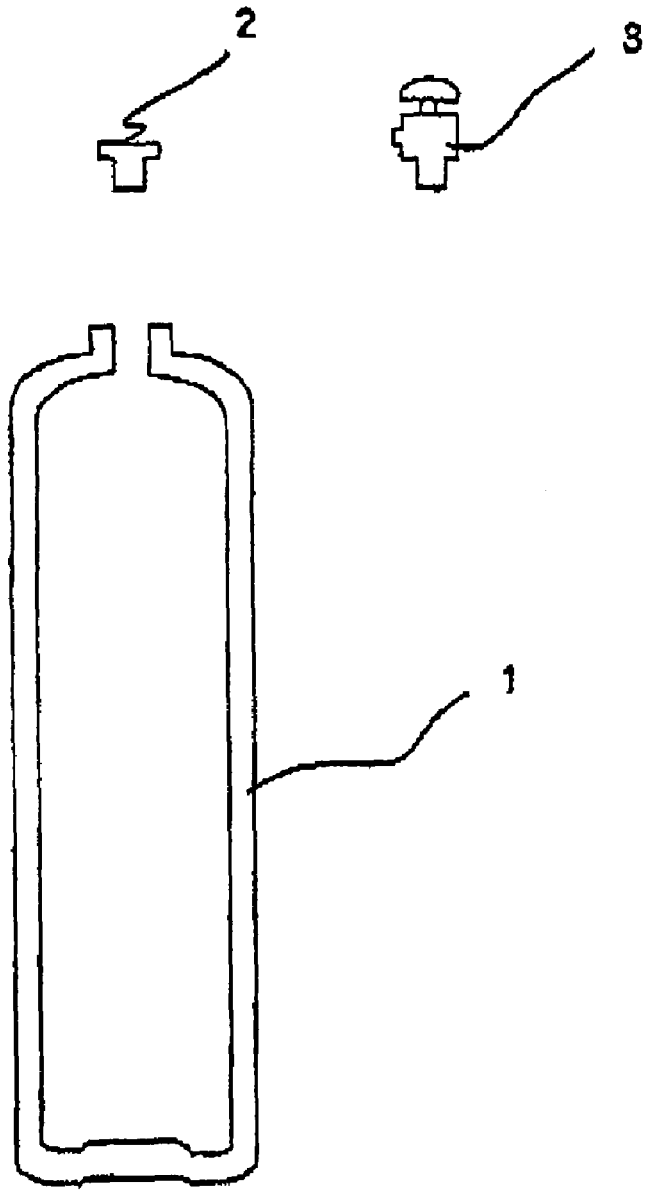
FIG. 1 is a schematic view of a steel cylinder.
Figure 2:
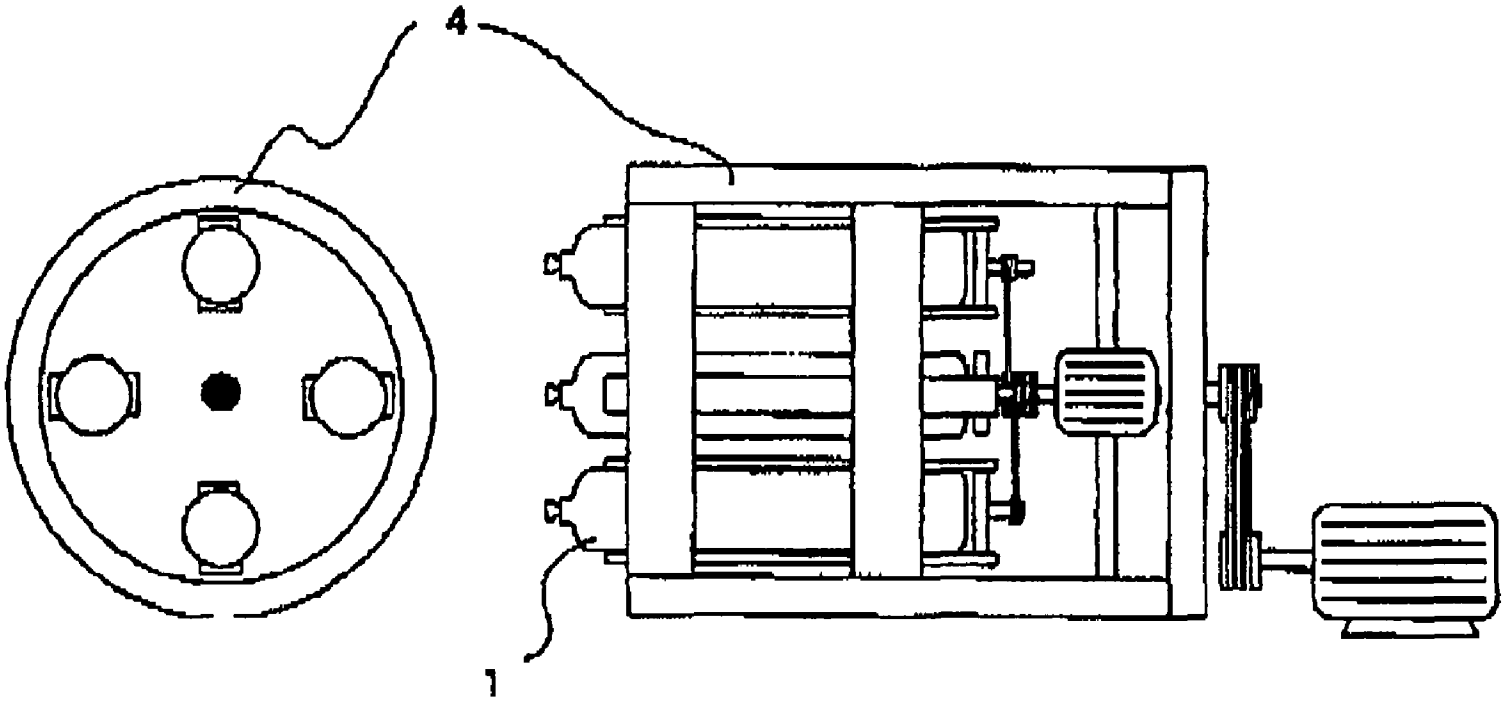
FIG. 2 is a schematic view of a polishing device.

To 3 pieces of 47 L volume iron-manganese steel high pressure jointless containers having 6S inner surface roughness after applying a pressure test by hydraulic pressure, 3 L of water with 5 kg of spherical alumina balls of 50 weight ppm Si content, having a 5 mm diameter, 5 kg of spherical alumina balls of 50 weight ppm Si content, having a 3 mm diameter, and 300 g of alumina powders having 50 weight ppm Si content, having a 50 μm average particle size dispersed was introduced, and an airtight plug 2 was put on the upper part valve connection screw part. With the container turned sideways so as to be set on a polishing device 4 illustrated in FIG. 2, a polishing process was started by switching on the polishing device.

After polishing for 60 minutes, the container was turned upside down for removing the contents, and furthermore, the residual solid component was discharged by jetting with high pressure pure water for 5 minutes. Thereafter, the container inside was washed with isopropyl alcohol for substituting the pure water. The inner surface coarseness was confirmed to be polished to 2S.

Furthermore, the container was placed in a drier at 180° C. for drying the container inside for 2 hours while substituting with dry $N_2$. One of the containers was cut so as to produce an analysis test piece of about 2 cm square for measuring the X-ray photoelectron spectrum on the container inner surface side by the below-mentioned conditions.

Device: Quantum 2000 produced by Ulvac-Phi Inc.

X-ray source: monotone AlKα line

Photoelectron taking out angle: 45°

Measurement area: 1.4 mm×0.3 mm (0.4 $mm^2$)

Pass energy: 23.5 eV (Energy resolution of the $Ag3d_{5/2}$ peak of a pure silver: about 0.7 eV)

The narrow scanning measurement was executed for each of the Fe2p area and the Si2s area. The Si2s peak was not detected significantly, and the value obtained by dividing the area of the Si2s peak by the area of the $Fe2p_{3/2}$ peak was less than 0.01.

Moreover, the container weight was measured before and after polishing, and the average polishing thickness of the container inside found out from the weight reduction in the above-mentioned process was 10.4 μm. A test piece was produced from the cut container for photographing the inner side surface with a VH-7000 type surface electron microscope produced by the Keyence Corporation. The image was taken into a computer for measuring the total length of the minute cracks in a range of 1 to 30 μm depth in an optional 1 cm square, and it was 17 cm.

A valve was mounted on another container, and it was placed in a 60° C. drier for drying for 2 hours while applying a vacuum to the inside. After cooling down to room temperature, it was filled with a high purity He gas of 99.999% purity to a 5 MPa pressure. The He gas in the container was collected after 1 day, 7 days and 30 days after the filling date for water content analysis using a quartz oscillating moisture analyzer. As it is shown in the table, water content increase was not observed.

A valve was mounted on the other container, and it was placed in a 60° C. drier for drying for 2 hours while applying a vacuum to the inside. After cooling down to room temperature, it was filled with a high purity $NF_3$ gas of 99.999% purity to a 10 MPa pressure. 190 NL of the $NF_3$ gas filled in the container was bubbled into 200 g of ultra pure water after 1 day, 7 days and 30 days after the filling date for measuring the F and the Si concentration of the liquid. As it is shown in the table, the time passage increase of the F and Si concentration were not observed so that it was confirmed that a silicon fluoride was not produced significantly.

Example 2

In the same method as in the example 1 except that the content at the time of the polishing process was changed to 3 L of water with 10 kg of a spherical polishing agent of an alumina-silica based composite oxide of 9 wt % Si content, having a 3 mm diameter, and 300 g of a powdery polishing agent having a 50 μm average particle size dispersed, and the washing time for discharging the residual solid component by the high pressure pure water was changed to 60 minutes, the inner surface treatment, the content discharging process, washing with water, and washing with an isopropyl alcohol were performed on 3 pieces of 47 L volume iron-manganese steel high pressure jointless containers having 6S inner surface roughness after applying a pressure test by hydraulic pressure. The inner surface coarseness after the process was 2S. Thereafter, the drying process was conducted, and a test piece was produced for one of the containers for the XPS measurement and the total length measurement for the cracks. The average polishing thickness of the container was 12.8 μm. The other container was filled with a high purity $NF_3$ gas for the F and Si analysis. Using the other container, the water content measurement was conducted with an He gas. The conditions were same as in the example 1.

The value of dividing the area of the Si2s peak by the area of the $Fe2p_{3/2}$ peak in the X-ray photoelectron spectrum was 0.23. Moreover, the total length of the cracks in an optional 1 cm square was 8 cm. Furthermore, the F, Si concentrations of the filled gas absorbed liquid were as shown in the table. Although slight concentration rise was observed after 30 days from filling, it was in the allowance range. Moreover, the water content in the He gas was not increased until 30 days after filling as shown in the table.

Example 3

2 pieces of 47 L volume iron-manganese steel high pressure jointless containers 1 having 25S inner surface roughness after applying a pressure test by the hydraulic pressure were prepared. With 5 kg each of substantially spherical high purity alumina polishing agents (Si content: 50 wt ppm) having 5 mm and 3 mm diameter placed therein as the polishing agent, and furthermore, 1 kg of pure water, and an airtight plug 2 was put on the upper part valve connection screw part. With the container turned sideways so as to be set on a polishing device 4 shown in FIG. 2, a polishing process was started by switching on the polishing device. After polishing for 1 hour, the polishing agent was taken out, and the container was washed with isopropyl alcohol. It was polished to an inner surface roughness of 3S grade by the method. Furthermore, after substituting the inside of the container with a dry $N_2$, a valve 3 was mounted thereon, and it was placed in a drier at 100 to 200° C. for drying for 2 hours while applying a vacuum to the inside. The average polishing thickness obtained from the weight difference before and after polishing was 9.4 μm.

After cooling down to room temperature, a 99.999 Vol % high purity $NF_3$ gas was filled to one of the containers to 10 MPa, and a 99.999 vol % high purity He gas was filled to the other one to 5 MPa. As to the container filled with the $NF_3$ gas, 190 NL of the filled $NF_3$ gas was bubbled into 200 g of ultra pure water after passing through a 0.01 μm metal filter after 1 day, 7 days and 30 days after the filling date so as to use the water as the analysis sample. As a result of the F ion and Si analysis, the time passage change was not observed. Moreover, as to the container filled with the He gas, the water content in the filled He gas was measured by a quartz oscillating moisture analyzer after 1 day, 7 days and 30 days after filling. Although the water content value increased slightly after passage of 30 days, it was in the allowance range. The above-mentioned test results are shown in the table. The analysis values shown here are the values converted to the $NF_3$ gas weight basis.

Example 4

In the same method as in the example 1 except that the polishing agent was changed to a mixture of 10 kg of a spherical 3 mm diameter alumina silica based polishing agent (Si content: 9 wt %) and 300 g of a 50 μm average particle size alumina powder (Si content: 100 wt ppm), the inner surface treatment was conducted for 47 L volume iron-manganese steel high pressure Pointless containers having 6S inner surface roughness after applying a pressure test by hydraulic pressure. By the method, it was polished to an inner surface roughness of 2S grade. The average polishing thickness was 9.4 μm.

The same evaluation as in the example 1 was conducted. As it is shown in the table, the time passage change of the water content in the He gas, the F ion and Si in the $NF_3$ gas were not observed. The analysis values are the values converted to the $NF_3$ gas weight basis.

Example 5

In the same method as in the example 1 except that the polishing agent was changed to 10 kg of a spherical 3 mm diameter alumina silica based polishing agent (Si content: 9 wt %), 1 kg of a 0.05 N KOH aqueous solution was added instead of the pure water, and the polishing time was changed to 2 hours, the inner surface treatment was conducted for 47 L volume iron-manganese steel high pressure Pointless containers having 6S inner surface roughness after applying a pressure test by hydraulic pressure. The inner surface roughness became 1S grade, and the average polishing thickness was 16.7 μm.

The same evaluation as in the example 1 was conducted. As it is shown in the table, the time passage change of the water content in the He gas, the F ion and Si in the $NF_3$ gas were not observed. The analysis values are the values converted to the $NF_3$ gas weight basis.

Example 6

To 3 pieces of 47 L volume iron-manganese steel high pressure jointless containers having 6S inner surface roughness after applying a pressure test by hydraulic pressure, 3 L of water with 10 kg of a spherical 3 mm diameter alumina silica based polishing agent (Si content: 9 wt %) was introduced, and an airtight plug 2 was put on the upper part valve connection screw part. With the container turned sideways so as to be set on a polishing device 4 shown in FIG. 2, a polishing process was started by switching on the polishing device.

After polishing for 60 minutes, the container was turned upside down for removing the contents, and furthermore, the residual solid component was discharged by jetting with high pressure pure water for 5 minutes.

Then, to 3 pieces of the container, 3 L of a 0.05N KOH aqueous solution with 5 kg of spherical alumina balls of 50 weight ppm Si content, having a 5 mm diameter, 5 kg of spherical alumina balls of 50 weight ppm Si content, having a 3 mm diameter, and 300 g of alumina powder having 50 weight ppm Si content, having a 50 μm average particle size dispersed were introduced, and an airtight plug 2 was put on the upper part valve connection screw part. With the container turned sideways so as to be set on a polishing device 4 shown in FIG. 2, the second polishing process was started by switching on the polishing device.

After polishing for 60 minutes, the container was turned upside down for removing the contents, and furthermore, the residual solid component was discharged by jetting with high pressure pure water for 5 minutes. Thereafter, the container inside was washed with isopropyl alcohol for substituting the pure water.

The average polishing thickness was 21.8 μm, and the inner surface roughness was 1S or less. The same evaluation as in the example 1 was conducted. As it is shown in the table, the time passage change of the water content in the He gas, the F ion and Si in the $NF_3$ gas were not observed. The analysis values are the values converted to the $NF_3$ gas weight basis.

Comparative Example 1

In the same method as in the example 1 except that the polishing agent was changed to a mixture of 10 kg of a spherical 3 mm diameter alumina silica based polishing agent (Si content: 20 wt %) and 300 g of a 50 μm average particle size alumina powder (Si content: 20 wt %), the inner surface treatment was conducted for 47 L volume iron-manganese steel high pressure jointless containers having 6S inner surface roughness after applying a pressure test by hydraulic pressure. The inner surface roughness was 2S grade. Moreover, the value obtained by dividing the area of the Si2s peak by the area of the $Fe2p_{3/2}$ peak in the X-ray photoelectron spectrum was 0.91.

The same evaluation as in the example 1 was conducted. As it is shown in the table, the Si and F values were increased after 7 days. The analysis values are the values converted to the $NF_3$ gas weight basis.

Comparative Example 2

In the same method as in the example 1 except that the polishing agent was changed to 10 kg of a spherical 3 mm diameter alumina silica based polishing agent (Si content: 30 wt %), and furthermore, 1 kg of a 0.05 N KOH aqueous solution was further added, the polishing process was conducted for 47 L volume iron-manganese steel high pressure jointless containers having 6S inner surface roughness after applying a pressure test by hydraulic pressure. The inner surface roughness was 2S grade. Moreover, the value obtained by dividing the area of the Si2s peak by the area of the $Fe2p_{3/2}$ peak in the X ray photoelectron spectrum was 2.26.

The same evaluation as in the example 1 was conducted. As it is shown in the table, the Si and F values were increased after 1 day from filling. The analysis values are the values converted to the $NF_3$ gas weight basis.

Comparative Example 3

The inside of 47 L volume iron-manganese steel high pressure Pointless containers having 6S inner surface roughness after applying a pressure test by hydraulic pressure was washed with an isopropyl alcohol without executing the polishing process, and then the drying process and the evaluation as in the example 1 were conducted. The inner surface was observed by an electron microscope, however, it was not able to measure the length of the minute cracks since the photographed image was not sufficiently sharp. The water content in the He gas filled in the container was increased by the passage of time as shown in the table.

Comparative Example 4

In the same method as in the example 1 except that the polishing time was changed to 20 minutes, the polishing process, washing of the inside, drying and evaluation were conducted for the 47 L volume iron-manganese steel high pressure jointless containers having 6S inner surface roughness after applying a pressure test by hydraulic pressure. The inner surface roughness was 3S to 4S, the average polishing thickness was 3.7 μm, and the total length of the minute cracks in a 1 cm square was 39.6 cm. As shown in the table, the water content in the He gas filled in the container was increased by the passage of time.

Comparative Example 5

In the same method as in the comparative example 4 except that the container drying temperature after washing with the isopropyl alcohol was changed to 240° C., the 47 L volume iron-manganese steel high pressure jointless containers having the 6S inner surface roughness after applying a pressure test by the hydraulic pressure were processed and evaluated. As shown in the table, the water content in the He gas filled in the container was increased by the passage of time.

It was found out that production of a silicon halide can be restrained after filling a halogen containing gas, and furthermore, the water content can be restrained in a processing method for the inner surface of a high pressure gas container mainly made of iron, which has had a pressure test by hydraulic pressure, by polishing the inner surface by 5 to 100 μm thickness, and controlling such that the value of dividing the area of the Si2s peak by the area of the $Fe2p_{3/2}$ peak in the X-ray photoelectron spectrum of the container inner surface is 0.3 or less. Thereby, a gas container without purity decline after filling a halogen containing gas, and a highly pure halogen containing gas can be provided.

TABLE 1

| Results of analyses | | | | | | | |
|---|---|---|---|---|---|---|---|
| | | Example 1 | Example 2 | Example 3 | Example 4 | Example 5 | Example 6 |
| Polishing thickness [μm] | | 10.4 | 12.8 | 9.4 | 9.4 | 16.7 | 21.8 |
| Residual crack total length [cm] | | 17 | 8 | — | — | — | — |
| Si/Fe area ratio | | <0.01 | 0.23 | — | — | — | — |
| Impurity concentration after the passage of time from filling [ppm] | | | | | | | |
| Water content | 1 day | <0.1 | <0.1 | <0.1 | <0.1 | <0.1 | <0.1 |
| | 7 day | <0.1 | <0.1 | <0.1 | <0.1 | <0.1 | <0.1 |
| | 30 day | <0.1 | <0.1 | 0.1 | <0.1 | <0.1 | <0.1 |
| Si | 1 day | <0.01 | <0.01 | <0.01 | <0.01 | <0.01 | <0.01 |
| | 7 day | <0.01 | <0.01 | <0.01 | <0.01 | <0.01 | <0.01 |
| | 30 day | <0.01 | 0.01 | <0.01 | <0.01 | <0.01 | <0.01 |
| F | 1 day | <0.01 | <0.01 | <0.01 | <0.01 | <0.01 | <0.01 |
| | 7 day | <0.01 | <0.01 | <0.01 | <0.01 | <0.01 | <0.01 |
| | 30 day | <0.01 | 0.02 | <0.01 | <0.01 | <0.01 | <0.01 |
| | | Comparative example 1 | Comparative example 2 | Comparative example 3 | Comparative example 4 | Comparative example 5 | |
| Polishing thickness [μm] | | — | — | — | 3.7 | — | |
| Residual crack total length [cm] | | — | — | — | 39.6 | — | |
| Si/Fe area ratio | | 0.91 | 2.26 | — | — | — | |
| Impurity concentration after the passage of time from filling [ppm] | | | | | | | |
| Water content | 1 day | — | — | 0.8 | <0.1 | 0.1 | |
| | 7 day | — | — | 1.5 | 0.5 | 0.5 | |
| | 30 day | — | — | 3.8 | 1.2 | 1.3 | |
| Si | 1 day | <0.01 | 0.79 | — | — | — | |
| | 7 day | 0.59 | 2.28 | — | — | — | |
| | 30 day | 2.66 | 4.08 | — | — | — | |
| F | 1 day | <0.01 | 1.80 | — | — | — | |
| | 7 day | 1.28 | 4.16 | — | — | — | |
| | 30 day | 5.50 | 7.55 | — | — | — | |

What is claimed is:

1. A processing method for a high pressure gas container comprising the step of polishing the inner surface of a high pressure gas container mainly made of iron, which has had a pressure test by hydraulic pressure, by 5 to 100 μm thickness on average such that the value of dividing the area of the Si2s peak by the area of the $Fe2p_{3/2}$ peak in the X-ray photoelectron spectrum of the container inner surface is 0.3 or less.

2. The processing method according to claim 1, wherein at least the final polishing is conducted with a polishing agent having a Si content of 10 wt % or less.

3. A halogen containing gas filled in-a high pressure gas container processed by polishing the inner surface of a high pressure gas container mainly made of iron, which has had a pressure test by hydraulic pressure, by 5 to 100 μm thickness on average such that the value of dividing the area of the Si2s peak by the area of the $Fe2p_{3/2}$ peak in the X-ray photoelectron spectrum of the container inner surface is 0.3 or less.

4. The halogen containing gas filled in a high pressure gas container according to claim 3, wherein the silicon halide content of the gas is 0.3 ppm or less.

5. A method for processing the inner surface of a fluorine containing gas container mainly made of iron, which has had a pressure test by hydraulic pressure, comprising the step of conducting at least the final polishing with a polishing agent having a Si content of 10 wt % or less.

* * * * *